United States Patent [19]

Kawabuchi

[11] Patent Number: 4,963,935

[45] Date of Patent: Oct. 16, 1990

[54] COPYING APPARATUS

[75] Inventor: Yoichi Kawabuchi, Osaka, Japan

[73] Assignee: Minolta Camera Kabushiki Kaisha, Osaka, Japan

[21] Appl. No.: 432,391

[22] Filed: Nov. 8, 1989

Related U.S. Application Data

[63] Continuation of Ser. No. 265,515, Nov. 1, 1988, abandoned.

[30] Foreign Application Priority Data

Nov. 2, 1987 [JP] Japan ..... 62-277850

[51] Int. Cl.[5] ..... G03G 15/06

[52] U.S. Cl. ..... 355/245; 355/326

[58] Field of Search ..... 355/245, 326, 328

[56] References Cited

U.S. PATENT DOCUMENTS

| | | | |
|---|---|---|---|
| 3,914,043 | 10/1975 | McVeigh . | |
| 4,707,110 | 11/1987 | Harada et al. | 355/326 |
| 4,761,668 | 8/1988 | Parker et al. | 355/328 |
| 4,771,314 | 9/1988 | Parker et al. | 355/245 |

FOREIGN PATENT DOCUMENTS

| | | |
|---|---|---|
| 60-232568 | 11/1985 | Japan . |
| 61-203474 | 9/1986 | Japan . |

*Primary Examiner*—R. L. Moses

*Attorney, Agent, or Firm*—Burns, Doane, Swecker & Mathis

[57] ABSTRACT

A copying apparatus provided with a plurality of developing units, and including a simultaneous multi-color copying control device for controlling to obtain an image in a plurality of colors by causing the plurality of developing units to be changed over for functioning during one copying operation, a simultaneous multi-color copying selecting device for selecting a simultaneous multi-color copying mode for effecting copying by the simultaneous multi-color copying control, and a developing unit selecting device for selecting the developing unit to be used from the plurality of developing units. The copying apparatus is so arranged that input from the developing unit selecting device is inhibited when the simultaneous multi-color copying mode has been selected.

4 Claims, 9 Drawing Sheets

COPYING APPARATUS

This application is a continuation of application Ser. No. 265,515, filed Nov. 1, 1988, now abandoned.

BACKGROUND OF THE INVENTION

The present invention generally relates to an image forming arrangement and more particularly, to a copying apparatus capable of effecting a simultaneous multi-color copying control for obtaining images in a plurality of colors by causing a plurality of developing units to function through change-over during one copying operation.

Conventionally, there has been known a copying apparatus provided with a plurality of developing units, and so arranged to effect color-copying in a single color such as red, yellow or the like through selection of a developing unit to be used from said developing units for different colors.

With respect to the above, there has also been previously proposed a copying apparatus capable of effecting a simultaneous multi-color copying control for obtaining an image in a plurality of colors in one copy paper sheet by causing the plurality of developing units to function through change-over during one exposure operation in the application assigned to the same assignee as in the present invention. By the above simultaneous multi-color copying control, it is possible to copy left and right sides of an original document into images of different colors or to emphasize particular portions of an original document by using different colors thereat, even by one copying operation, and therefore, there are such advantages that, not only labor required for operation of the copying apparatus or for setting of the original document is reduced to half, but time necessary for the copying may be remarkably decreased.

However, in the copying apparatus capable of effecting the simultaneous multi-color copying control as referred to above, in the case where, for example, two developing units are provided to enable the simultaneous multi-color copying control in two colors, since both of the two developing units are used in the simultaneous multi-color copying mode, there is no room for selecting the developing units. Therefore, in this case, operation of a developing unit selecting key is insignificant. Moreover, in such a case, if it is so arranged to accept an input from the developing unit selecting key, there is such as inconvenience that, in spite of the fact that there is no alteration of the developing unit while the simultaneous multi-color copying mode is selected, undesirable change-over is automatically effected to the developing unit selected during the simultaneous multi-color copying mode when the normal mode is restored, with the simultaneous multi-color copying mode being released.

Therefore, different developing units are undesirably selected before and after selection of the simultaneous multi-color copying mode as the developing unit to be used for the normal mode, and if copying is effected without noticing such a state, there is a possibility that a miscopying takes place thereby.

SUMMARY OF THE INVENTION

Accordingly, an essential object of the present invention is to provide a copying apparatus capable of effecting a simultaneous multi-color copying control, in which it is so arranged that the developing unit to be used is not different before and after the selection of the simultaneous multi-color copying mode.

Another object of the present invention is to provide a copying apparatus of the above described type which is simple in construction and stable in functioning at high reliability.

In accomplishing these and other objects, according to one preferred embodiment of the present invention, there is provided a copying apparatus which includes an electrostatic latent image holding member rotatively supported in the housing of the copying apparatus, means for exposing an image so as to form an electrostatic latent image on said electrostatic latent image holding member, a developing means which is disposed in the periphery of said electrostatic latent image holding member in the housing of the copying apparatus, and has at least a first developing unit housing a first developer and a second developing unit housing a second developer different in the color thereof from the color of the first developer housed in the first developing unit, a switching means for switching a copy mode from a first mode in which a monochrome copying operation is carried out by selecting any one of the developing units to a second mode in which a plural color copying operation is carried out during one image exposure operation and vice versa, a developing unit selection means for selecting and specifying any one of the developing units, and an inhibiting means for inhibiting the selection of the developing unit when the second mode is specified by said switching means.

In the above arrangement of the present invention, when the second copying mode is selected by the switching means, the plural color copying operation is carried out. During this period, even when the developing unit selecting means is operated, the input from the developing unit selecting means is inhibited, and the selection of the developing unit during the second copying mode is not executed, while, even after the second copying mode has been released, selection of the developing unit through operation of the developing unit selecting means during the second copying mode is not executed.

BRIEF DESCRIPTION OF THE DRAWINGS

These and other objects and features of the present invention will become clear from the following description taken in conjunction with the preferred embodiments thereof with reference to the accompanying drawings, in which.

DETAILED DESCRIPTION OF THE INVENTION

Figure 1:
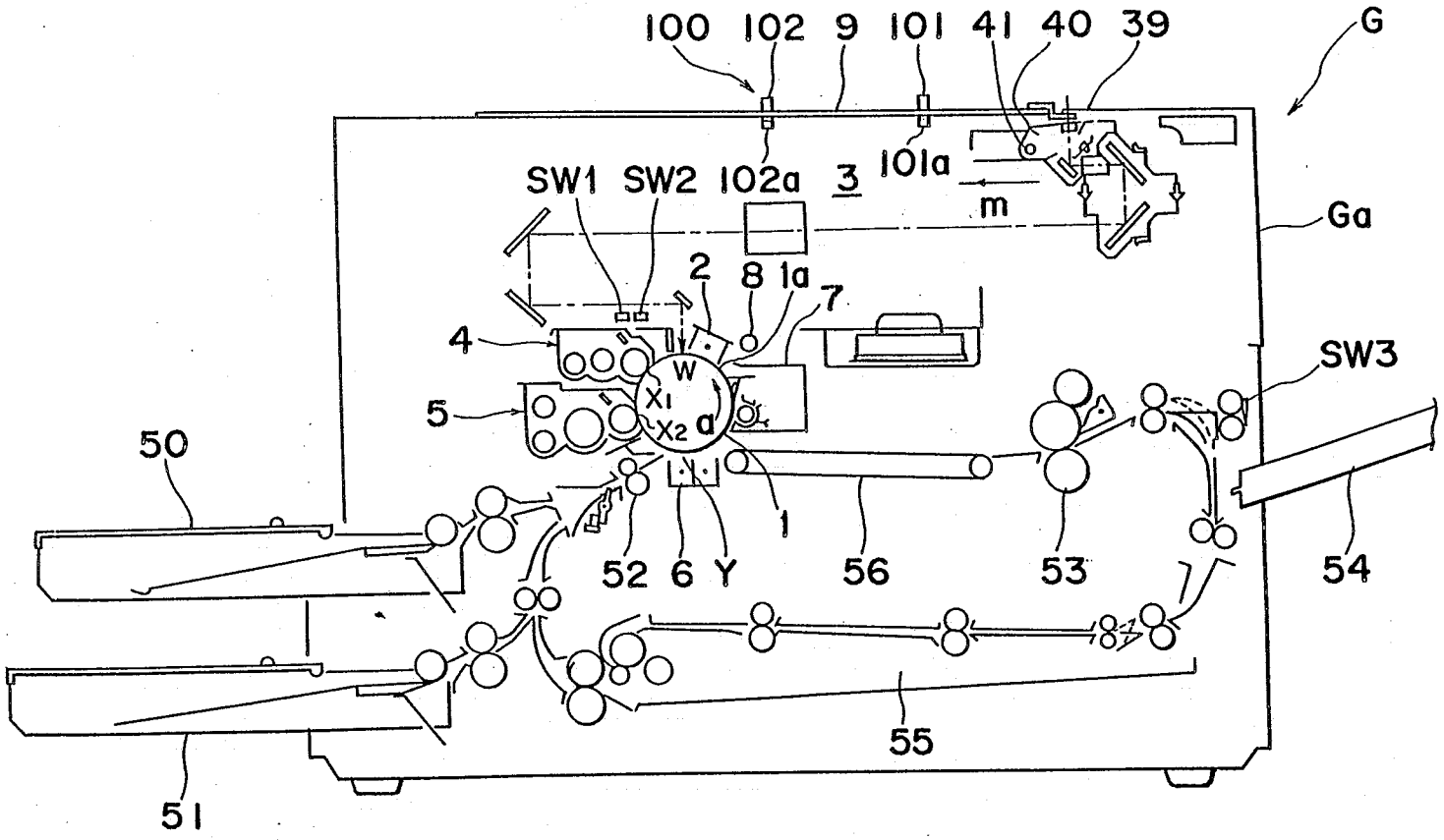
FIG. 1 is a schematic side sectional view showing general construction of a copying apparatus provided with a simultaneous multi-color copying function, to which the present invention may be applied.

Before the description of the present invention proceeds, it is to be noted that like parts are designated by like reference numerals throughout the accompanying drawings.

Referring now to the drawings, there is shown in FIG. 1 an electrophotographic copying apparatus provided with a simultaneous multi-color copying function, to which the present invention may be applied and the general construction of which will be described hereinbelow together with the standard copying operation for reproducing an image of an original document as it is.

In FIG. 1, the multi-color copying apparatus G generally includes a photosensitive or photoreceptor drum 1 having a photosensitive surface 1*a* on its outer periphery and rotatably disposed generally at a central portion of an apparatus housing Ga for rotation in a direction indicated by an arrow a, and various processing stations such as a corona charger 2, a first developing unit 4 and a second developing unit 5, a transfer charger 6, a cleaning device 7 and an eraser lamp 8, etc. sequentially disposed around the photoreceptor drum 1 as shown.

In the state where the photoreceptor drum 1 is rotating in the direction of the arrow a, the photosensitive surface 1*a* of the photoreceptor drum 1 is charged with a predetermined amount of electrical charge through discharge by the corona charger 2.

Subsequently, a scanner 40 of an optical system 3 having an exposure lamp 41 and movably disposed below and adjacent to a transparent original document platform 9 of a glass material or the like provided at the upper portion of the housing Ga, projects light onto an original document (not shown) placed on said platform 9, while performing the scanning function in the direction of an arrow m, and the light reflected from the original document is projected onto the photosensitive surface 1*a* of the photoreceptor drum 1 via reflecting mirrors and a lens assembly through an exposure point W, and thus, an electrostatic latent image corresponding to the image of the original document is formed on said surface 1*a*.

The electrostatic latent image thus formed is developed into a visible toner image by toner at a developing region X1 or X2 corresponding in position to the first developing unit 4 or second developing unit 5 as the photoreceptor drum 1 rotates, thereby forming the toner image which is the reproduction of the original document image.

Meanwhile, the copy paper sheet is supplied selectively from a paper feeding section 50 or 51 provided at the lower left portion of the apparatus housing Ga in FIG. 1, and is transported to a portion confronting the transfer charger 6 (i.e., a transfer region Y) in timed relation with respect to the toner image formed on the photoreceptor drum 1. After having been transferred with the toner image thereon, the copy paper sheet is transported in between a pair of fixing rollers 53 through a transport belt 56 movably supported by rollers so that the toner image is fixed thereon by heat-fusing of toner, and is then discharged onto a discharge tray 54.

However, if a duplex or opposite side copying mode has been selected, the copy paper sheet is transported into a duplex device 55 so as to be turned over in its front and reverse faces thereat, and then, again transported to the transfer region Y, while at the optical system 3 and around the photoreceptor drum 1, a second copying function is effected in the similar manner as before so as to form the image on the reverse side of the copy paper sheet this time.

The toner remaining on the photosensitive surface 1*a* of the photoreceptor drum 1 is scraped off therefrom by the cleaning device 7, and further, residual charge thereon is also erased through irradiation of light by the eraser lamp 8 in preparation for subsequent development.

In addition to the standard copying as described above or a single color copying which is effected through selection of a desired developing unit, the copying apparatus G is also capable of effecting a function to obtain a two-colored image by causing two developing units 4 and 5 to function through change-over in one copying operation, based on one scanning function by the scanner 40 (referred to as a simultaneous multi-color copying control or simultaneous multi-color copying), and for this purpose, an image editing mechanism 100 is provided.

Figure 2:
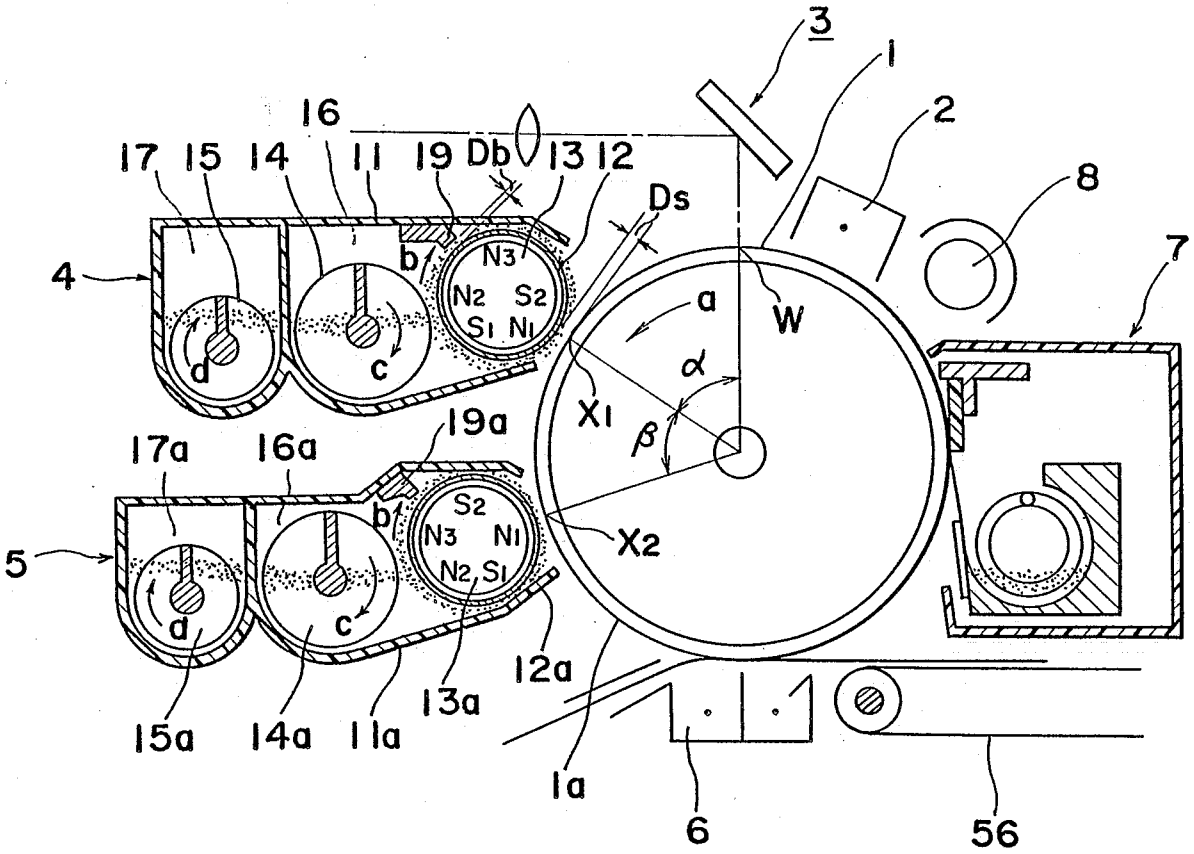
FIG. 2 is a fragmentary side sectional view showing on an enlarged scale, a photoreceptor drum, developing units and neighboring portions thereof, as employed in the copying apparatus of FIG. 1.

FIG. 2 shows surrounding portions of the photoreceptor drum 1, especially, the first and second developing units on an enlarged scale.

It should be noted here that the numerals for the constitutional parts of the second developing unit 5 are affixed with "a" for differentiation from those of the developing unit 4.

As is seen from FIG. 2, each of the developing units 4 and 5 having construction generally equal to each other includes a developing tank 11 open at its one edge adjacent to the photosensitive surface 1*a* of the photoreceptor drum 1, and a developing sleeve 12, a supply roller 14 and a screw 15 rotatably provided within said developing tank 11 in that order sequentially from the side of the photoreceptor drum 1. In the first developing unit 4, a developing material composed of magnetic carrier and insulative color toner is accommodated, while in the second developing unit 5, another developing material composed of magnetic carrier and insulative black toner normally used in contained.

The developing sleeve 12 made of a non-magnetic electrically conductive material formed into a cylindrical shape (24.5 mm in diameter) is formed with very small concave and convex portions or undulations on its outer peripheral surface by sand blast processing, and confronts the photosensitive surface la of the photoreceptor drum 1 at the developing region X1 or X2 through a developing gap Ds (=0.6 mm), with rotational angles from the exposure point W to the developing regions X1 and X2 being respectively set as ($\alpha$) and ($\alpha+\beta$), wherein $\alpha$ is set at 56° and $\beta$ at 52°.

Meanwhile, at the back face side of the developing sleeve 12 with respect to the developing region X, a magnetic brush bristle height restricting plate 19 is provided at an upper inner portion of the developing tank so as to confront the surface of said developing sleeve 12 through a bristle height restricting gap Db (=0.4 mm).

Within the developing sleeve 12, there is disposed a magnet roller 13 having a plurality of magnets extending in the axial direction, and magnetic forces of magnetic poles N1, N2 and N3, and S1 and S2 located at outer peripheral faces of such magnets are respectively set as N1=1000 G, N2 and N3=500 G, and S1 and S2=800 G (G is an abbreviation of a unit of gauss).

This magnet roller 13 is associated with a solenoid (not shown) so as to be driven for rotation through a predetermined angle.

In FIG. 2, transport passages for the developing materials within the developing tanks 11 and 11*a* are represented by numerals 16, 17, 16*a* and 17*a*, respectively.

Hereinafter, the image editing mechanism 100 will be described.

Figure 3:
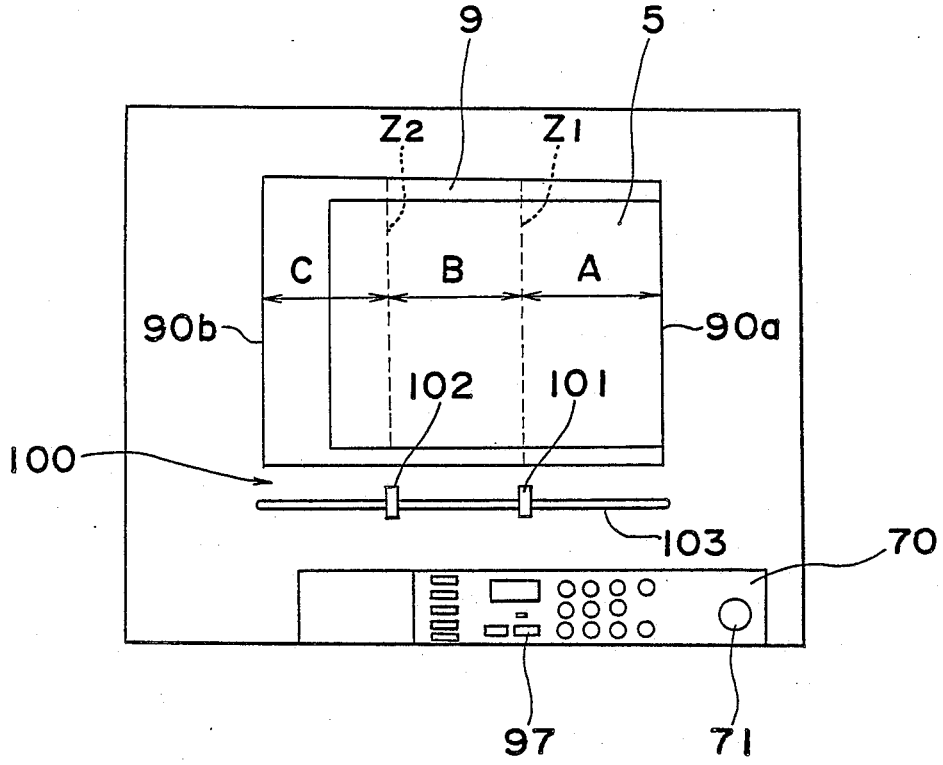
FIG. 3 is a top plan view of the copying apparatus of FIG. 1.
Figure 4:
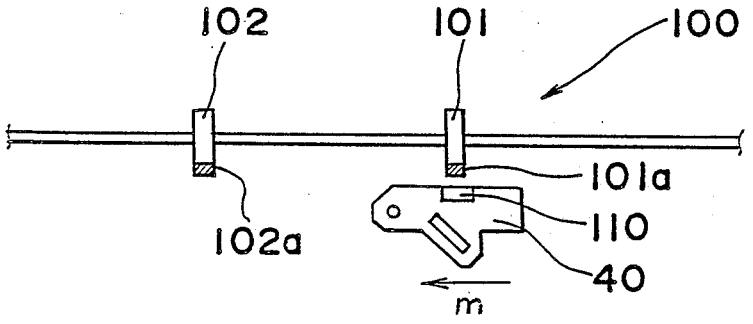
FIG. 4 is a fragmentary front elevational view showing on an enlarged scale, first and second lever portions employed in the arrangement of FIG. 3.

In FIGS. 3 and 4, first and second levers 101 and 102 of the image editing mechanism 100 are arranged to designate regions by dividing the original document placing surface of the transparent original document platform 9 in the moving direction of the scanner 40 (in a direction indicated by an arrow m), with simultaneous designation of the reproducing color, and are slidably fitted in a guide groove 103 formed in the scanning direction of the scanner at the side portion of the original document platform 9, while, within the apparatus housing Ga, in positions under the levers 101 and 102, there are respectively provided magnets 101*a* and 102*a*.

Thus, as illustrated in FIG. 3, in the state where the respective levers 101 and 102 are set, regions are designated in such a manner that the portion from the forward edge 90*a* of the original document platform 9 to the first lever 101 is a region A, the portion from the first lever 101 to the second lever 102 is a region B, and the portion from the second lever 102 to the rear edge 90*b* of the platform 9 is a region C, while the regions A and C are designated as white and black, with the region B being designated as color (red or yellow).

On the other hand, a reed switch 110 is provided on the scanner 40 of the optical system 3 so as to detect the magnets 101*a* and 102*a* for applying signals thereby to the control device (not shown).

Figure 5:
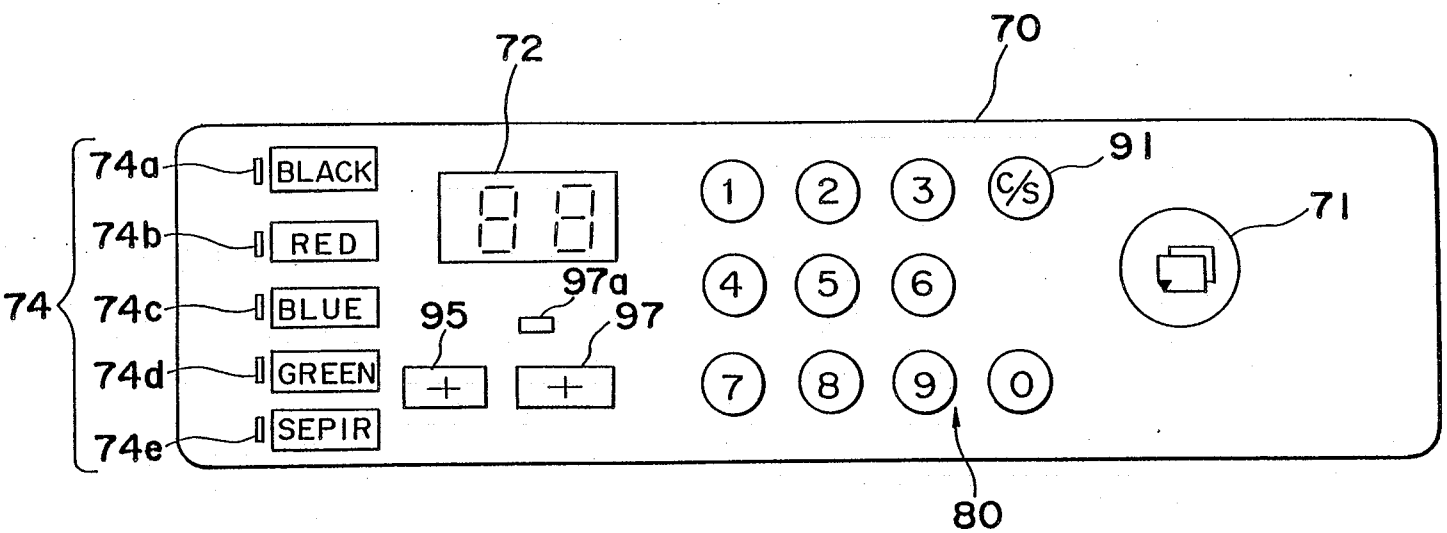
FIG. 5 is a top plan view showing on an enlarged scale, a control panel employed in the arrangement of FIG. 3.

Reference is further made to FIG. 5 showing a control panel 70 also illustrated in FIG. 3 on an enlarged scale.

On the control panel 70, there are provided a print key 71, a simultaneous multi-color copying select key 97, ten-keys 80 for setting the number of copies to be taken, a clear/stop key 91, a developing unit select key 95 for change-over between the first and second developing units 4 and 5, a display portion 72 for displaying the set number of copies to be taken, a toner color display portion 74 including LED indicators 74*a* to 74*e*, and a simultaneous multi-color display portion 97*a* for displaying that the simultaneous multi-color copying mode is selected by the simultaneous multi-color copying select key 97.

Figure 6:
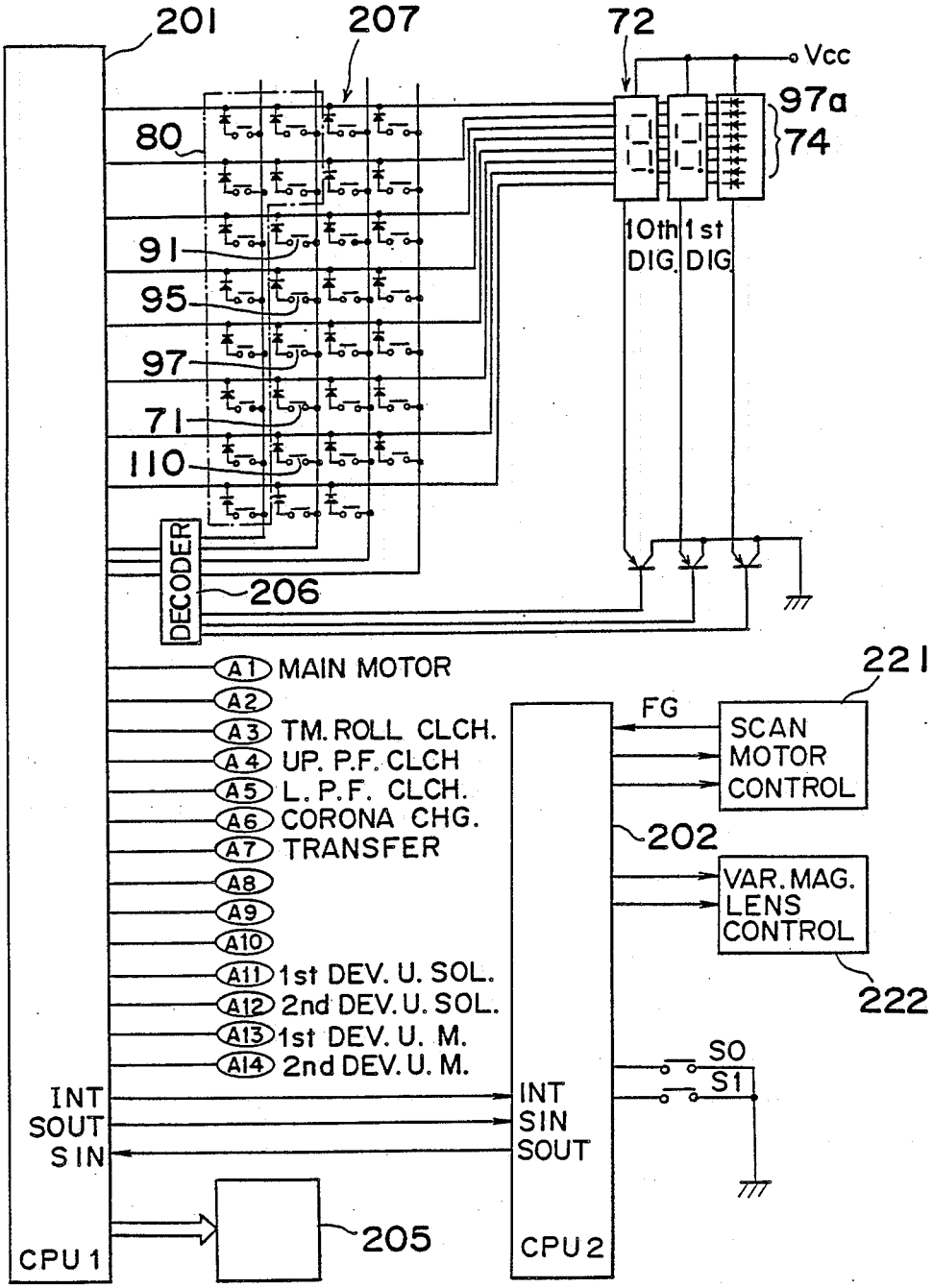
FIG. 6 is an electrical circuit diagram showing construction of a control circuit for the copying apparatus of FIG. 1.

Referring also to FIG. 6, there is shown a control circuit for the copying apparatus as described so far, which generally includes a first CPU (central processing unit) 201 for copying control, a second CPU 202 for optical system control, and a RAM (random access memory) 205 which are coupled to each other for mutual synchronization, while a switch matrix 207 in which input keys such as the ten-keys 80, developing unit selecting key 95, etc. on the control panel 70 and detecting sensors such as the reed switch 110 and the like are vertically and laterally arranged, is connected to the first CPU 201.

To the output terminals A1 through A14 of the first CPU 201, a main motor, developing motors, various clutches, change-over solenoids for levers, etc. are connected as shown so as to be controlled for "on" or "off" based on signals from the switch matrix 207 referred to above. Moreover, various display portions such as simultaneous multi-color copying display portion 97*a* and the like are also connected to the first CPU 201 through a decoder 206 so as to be controlled for energization or deenergization.

Meanwhile, to the second CPU 202, there are connected a driving control section 221 of a DC motor for the optical system scanning, and a driving control section 222 of a stepping motor for the lens displacement, etc.

Figure 11:
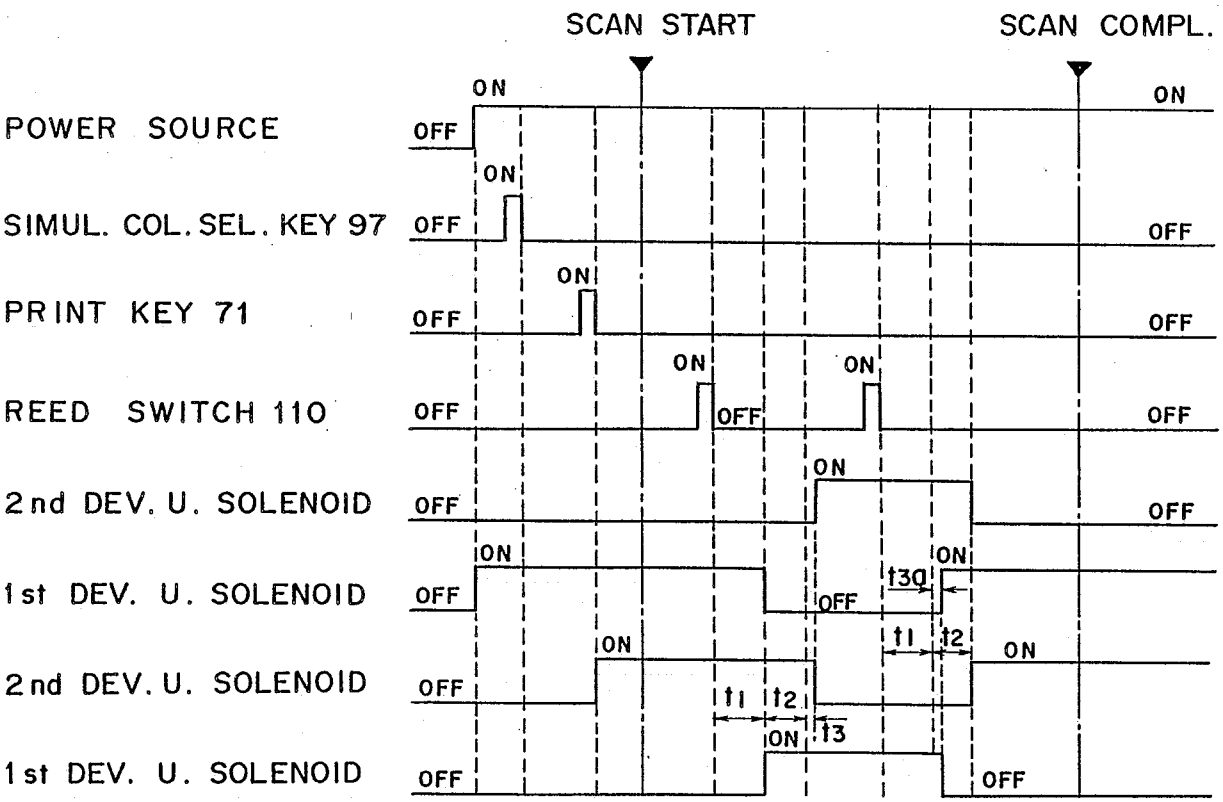
FIG. 11 is a timing chart showing the state of functioning of the developing units in the simultaneous color copying.

Subsequently, control of the copying apparatus having the constructions as described so far will be described by referring to FIGS. 2 and 11 mainly with respect to the functions of the developing units in the case where the simultaneous multi-color copying control is to be effected.

In the first place, when the power source is turned on through operation of a main switch (not shown) for the copying apparatus, the intermediate portion between the magnetic poles N1 and S1 of the magnet roller 13 confronts the photosensitive surface 1*a*of the photoreceptor drum 1 in the first developing unit 4, while the magnetic pole N1 faces said surface 1*a* in the second developing unit 5 as illustrated in FIG. 2.

Upon turning on of the print key 71 in the above state, the second developing unit 5 containing the black toner is automatically driven for effecting the standard copying function, and when simultaneous multi-color copying select key 97 is turned on, the setting is so made that the simultaneous multi-color copying can be effected. It is to be noted, however, that even if this select key 97 is depressed during the copying operation, such simultaneous multi-color copying is not carried out.

When the simultaneous multi-color copying select key 97 is turned on, the copying mode is altered from ordinary copying to the simultaneous multi-color copying mode. At this time, the LEDs of the toner color display portion 74 for the developing units to be used for the simultaneous multi-color copying mode, i.e., for the developing units 4 and 5, are illuminated. For example, if these two developing units contain black and red toners, the LEDs 74*a* and 74*b* are lit.

In the above state, the regions A and C for effecting the white and black copying, and the region B for effecting the color copying are designated as shown in FIG. 3 by sliding the first and second levers 101 and 102 along the sliding groove 103.

It should be noted here that the levers 101 and 102 are effective only when the simultaneous multi-color copying is selected, and arranged not to function at all, even if operated at a time other than above.

Under the state set as described so far, when the print key 71 is turned on, with an original document placed on the original document platform 9 as shown in FIG. 3, a developing motor for the second developing unit 5 is started, and the developing sleeve 12*a*, supply roller 14*a* and screw 15*a* are respectively rotated in the directions indicated by the arrows b, c and d.

Accordingly, the developing material containing the black toner and accommodated in the developing tank 11*a* is circulated for transportation through the transport passages 16*a* and 17*a*, while being mixed and stirred based on the rotation of the supply roller 14*a* and screw 15a, and part of the developing material is supplied onto the surface of the developing sleeve 12a by the supply roller 14a so as to form the magnetic brush of the developing material on said developing sleeve.

The magnetic brush thus formed passes through the brush bristle height restricting gap Db as it is cut off by the bristle height restricting member 19a based on the rotation of the developing sleeve 12a so as to be successively fed out onto the developing region X2 for contact with the photosensitive surface 1a of the drum 1a at a predetermined width, thereby establishing the state capable of developing the electrostatic latent image formed on said photosensitive surface 1a.

Meanwhile, based on the turning on of the print key 71, the scanner 40 starts functioning in the direction of the arrow m so as to project light onto an original document placed on the original document platform 9, and the light reflected therefrom is projected onto the photosensitive surface 1a of the photoreceptor drum 1 at the exposure point W so as to form the electrostatic latent image of the original document on said surface 1a. The latent image thus formed is first developed by the second developing unit 5.

Figure 12:
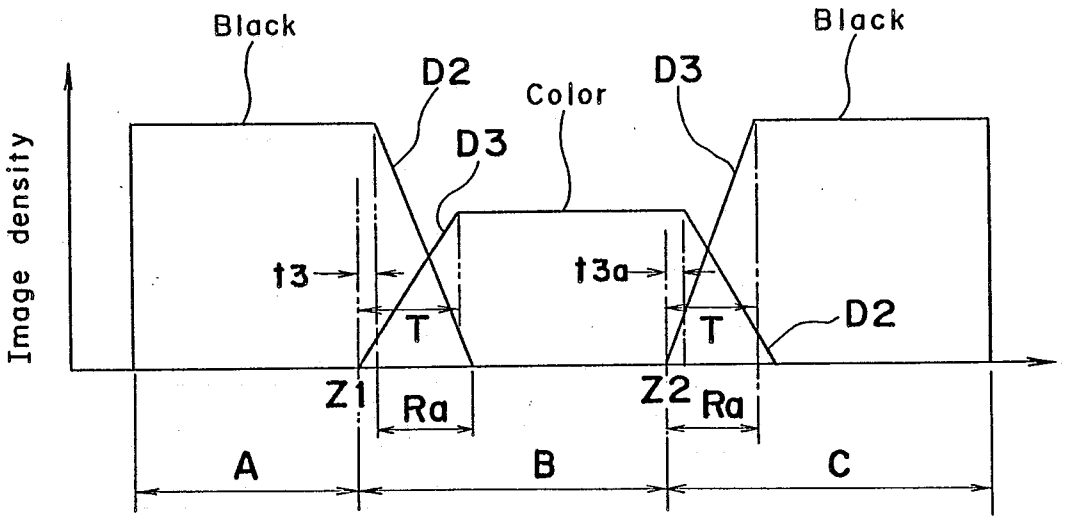
FIG. 12 is a diagram showing the state of variation in density during change-over of the developing units.

It should be noted here that, at the developing region X2, since the leading edge of the electrostatic latent image and the latent image immediately following thereafter contacts the magnetic brush after the developing unit 5 has been fully raised in its function, the image density rises very rapidly here (FIG. 12).

Subsequently, when the magnet 101a of the first lever 101 is detected by the reed switch 110 of the scanner 40, said reed switch 110 applies its signal to the control device.

It is to be noted here that this time point, the latent image corresponding to a boundary portion Z1 between the regions A and B where change-over is effected from black to color (red), is located at the exposure point W on the photosensitive surface 1a of the photoreceptor drum 1, and during the time period (t1=0.22 sec) in which the boundary portion Z1 is displaced from the position of the exposure point W up to the developing region X1 of the first developing unit 4, only the second developing unit 5 is successively operated.

After a time period t1 from the turning on of the reed switch 110, when the boundary portion Z1 of the electrostatic latent image reaches the developing region X1, the first developing motor is turned on, while the first developing solenoid is turned off. By the above operation, the first developing unit 4 is set in the similar manner as in the second developing unit 5, with the developing sleeve 12, supply roller 14 and screw 15 being respectively rotated in the direction indicated by the arrows b, c and d, and the magnetic brush is formed on the surface of the developing sleeve 12, thereby establishing the state capable of developing the latent image on the surface 1a of the photoreceptor drum 1. Thus, at the first developing unit 4, function to supply the color toner to the latent image corresponding to the region B is started.

However, at the time point when the first developing unit 4 is started, in the electrostatic latent image located at the developing region X1, the portion thereof positioned at the upstream side in the rotational direction of the photoreceptor drum 1 is different from that positioned at the downstream side thereof in the time for contacting the magnetic brush.

Accordingly, as shown in FIG. 12, the image density at the leading edge of the region B is gradually brought into a stable state through the developing rising region D3.

Then, after a time period t2 from the starting of the first developing motor (=0.2 sec), the boundary portion Z1 of the latent image reaches from the developing region X1 to the developing region X2 for the second developing unit 5.

At this time point, however, the developing motor and solenoid of the second developing unit 5 are not altered in the state of functioning so as to be set through a delay of time t3 thereafter, and th intermediate portion between the magnetic poles N1 and S1 confronts the surface 1a of the photoreceptor drum 1, with the developing sleeve 12, supply roller 14 and screw 15 stopping rotation, and thus, the developing function for the region A by the black toner is terminated.

It is to be noted here that, since the electrostatic latent image on the photosensitive surface 1a of the drum 1 contacts the developing material at a predetermined width, the image density thereof is not reduced rapidly, but is gradually lowered through the developing region D2 as shown in FIG. 12.

It should also be noted here that, as shown in FIG. 12, the time t3 is properly set within a developing rising time period T from the starting of the function of the first developing unit 4 to the stabilization of the density of the toner image formed on the photosensitive surface 1a.

Accordingly, in the vicinity of the boundary portion Z1, images in black and color are overlapped for mixing in the color, but a mixed color width Ra in terms of visual observation is limited to the developing falling region D2 of the black image which is a high density image, while the vicinity of the boundary portion Z1 is perfectly reproduced.

When the scanner 40 is further displaced, and reaches the position of the second lever 102, i.e., the boundary portion Z2 between the regions B and C, the reed switch 110 detects the magnet 102a so as to be again turned on for outputting the signal to the control device. It is to be noted here that at this time, the electrostatic latent image corresponding to the boundary portion Z2 is located at the exposure point W.

After a time period t1 from the turning on of the reed switch 110, the electrostatic latent image at the boundary portion Z2 reaches the developing region X1.

However, at this time point, the developing motor and solenoid for the first developing unit 4 are not altered in the state of function, and through a delay of a time t3, the first developing motor is turned off, with the first developing solenoid turned on, and thus, the color developing at the region B is terminated. The time t3 is also properly set in the developing rising time period T from the starting of the second developing unit 5 to the stabilization of the density of the toner image formed on the photosensitive surface 1a by the first developing unit 4 in the similar manner as in the time t3 referred to earlier.

By the above arrangement, as shown in FIG. 12, the development is effected by the color toner for the time period t3 even after the boundary portion Z2, and the image density is lowered thereafter, through the developing falling region D2.

Further, after a time (T1+t2) from the "on" function of the reed switch 110, i.e., upon arrival of the boundary portion Z2 of the electrostatic latent image located at the developing region X1, at the developing region X2 of the second developing unit 5, the second developing motor is turned on, with the second developing unit solenoid turned off, and thus the black development for the region C is started.

In the above development also, similarly to the developing function at the leading edge of the region B by the first developing unit 4 as described earlier, at the time point when the second developing unit 5 is started, time for contacting the magnetic brush is different between the electrostatic latent image located at the upstream side of the developing region X1 and that located at the downstream side thereof and therefore, the image density by the black toner in the region C does not rise rapidly, but is gradually shifted into a stable state through the developing rising region D3.

As a result, in the vicinity of the boundary portion Z2, images in black and color are to be overlapped with each other for mixed color in the similar manner as in the vicinity of the boundary portion Z1 described earlier, but the mixed color width Ra by visual observation is limited to the developing falling region D2 of the black image which is of a high density image, and the vicinity of the boundary portion Z2 may be perfectly reproduced.

The developing function of the second developing unit 5 is maintained up to the completion of scanning, and the development for the region C is terminated.

It is to be noted here that, with respect to the electrostatic latent image at the terminating end, since the developing is completed when the second developing unit 5 is fully, raised, the image density here rapidly falls to zero.

By the foregoing operation, between the starting and completion of the scanning, the two color composite copy in which the developing color is changed over from black to color, and further, to black, may be obtained.

Subsequently, referring to the flow-charts in FIGS. 7 to 10, control functions of the copying apparatus on the whole will be described.

Figure 7:
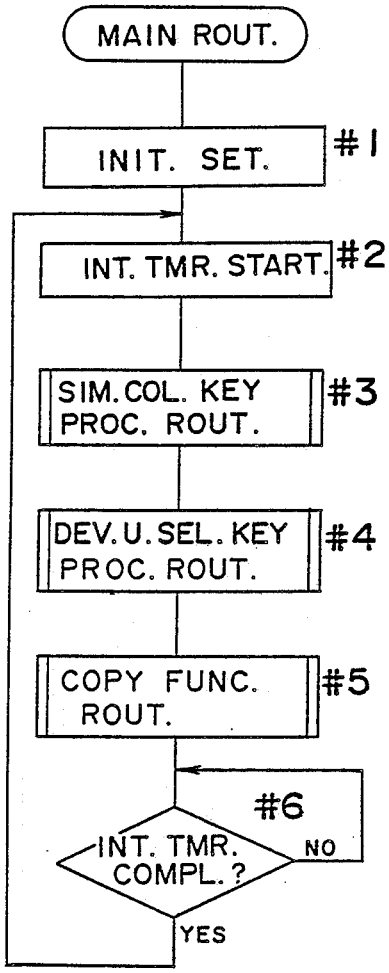
FIGS. 7 to 10 are flow-charts for explaining copying functions of the copying apparatus of FIG. 1.

In the flow-chart of FIG. 7 showing the main routine of the first CPU for controlling the copying apparatus on the whole, upon turning on of the power source for the copying apparatus in the first place, various initial settings are effected at step #1, such as initialization of the internal CPU, setting of various modes to the reference modes, setting of default values as various data, etc. In this case, the second developing unit 5 for black is normally selected.

At step #2, an internal timer for regulating time for one routine constant is started.

Subsequently, the simultaneous multi-color copying key processing routine, developing unit select key processing routine, and copying function processing routine are successively effected (steps #3 to #5).

Upon completion of all sub-routine processings, one routine is completed after termination of the internal timer which was set first (step #6), and the procedure again returns to step #2.

Figure 8:
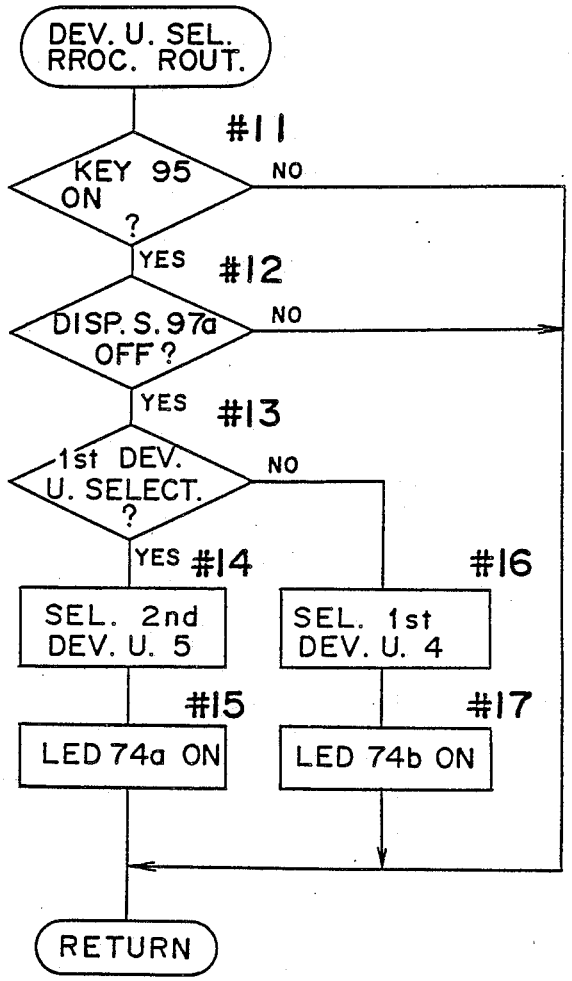

FIG. 8 is a flow-chart showing a developing unit select key processing routine.

At step #11, it is checked whether or not the developing unit select key 95 is actuated and is turned on, and if the result is "NO", the procedure returns, while if it is "YES", the procedure proceeds to step #12. At step #12, judgement is made as to whether or not the simultaneous multi-color copying display portion 97*a* is off, and if the result is "YES", the procedure proceeds to step #13. Here, even when the developing unit select key 95 is depressed, if the simultaneous multi-color copying mode has been selected (i.e., if the result is "NO" at step #12), returning is effected to the main routine without changing-over of the developing unit.

Meanwhile, if the simultaneous multi-color copying mode has not been selected (i.e., if the result is "YES" at step #12), it is checked whether or not the first developing unit 4 has been selected at present (step #13). If the result is "YES", the second developing unit 5 is selected (step #14), and the LED 74*b* for the color of the first developing unit 4 is de-energized, while the LED 74*a* for the second developing unit 5 is illuminated (step #15).

If the result is "NO" at step #13, the first developing unit 4 is selected (step #16), and the LED 74*a* for the second developing unit 5 is de-energized, while the LED 74*b* for the first developing unit 4 is energized (step #17).

Figure 9:
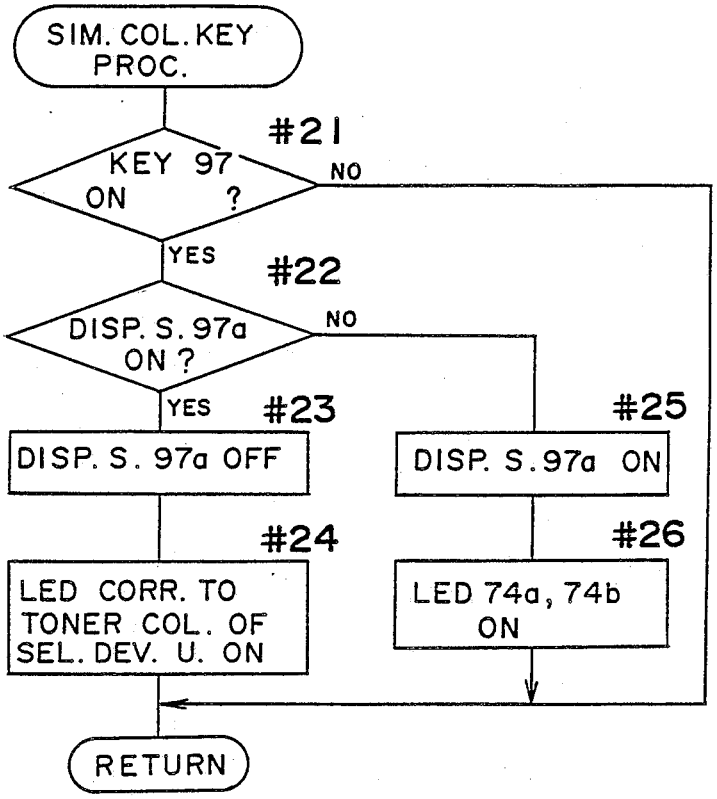

FIG. 9 is a flow-chart showing the simultaneous multi-color copying key processing routine.

At step #21, it is checked whether or not the simultaneous multi-color copying select key 97 is actuated and is turned on, and if the result is "NO", the procedure returns, while on the contrary if the result is "YES", the procedure proceeds to step #22 where judgement is made as to whether or not the simultaneous multi-color copying display portion 97*a* is on. When said display portion 97*a* is on (i.e., when the simultaneous multi-color copying mode has been selected), the simultaneous multi-color copying mode is released by turning off said display portion 97*a* (step #23), and the LED corresponding to the color of the developing unit as selected in the above developing unit select key processing routine is lit (step #24).

In the case where the simultaneous multi-color copying mode has not been selected (i.e., if the result is "NO" at step #22), the simultaneous multi-color copying mode is selected by turning on the display portion 97*a* (step #25), and the LEDs 74*a* and 74*b* corresponding to the colors of both of the first and second developing units 4 and 5 are illuminated (step #26).

Figure 10:
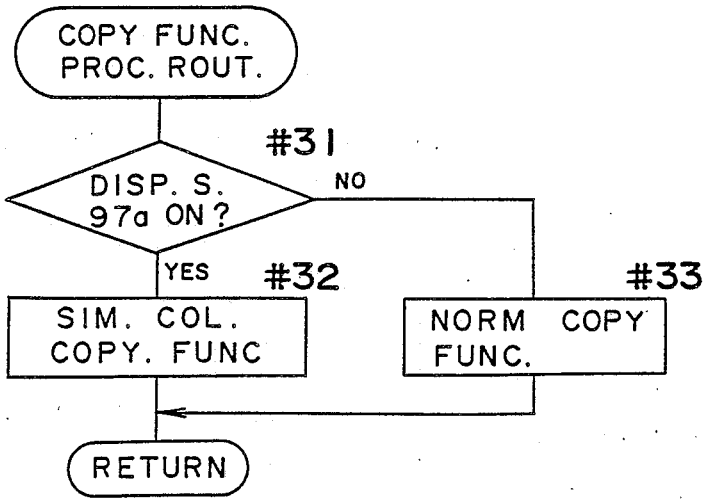

FIG. 10 is a flow-chart showing the copying function processing routine.

At step #31, it is checked whether or not the simultaneous multi-color copying display portion 97*a* is turned on, i.e., the simultaneous multi-color copying mode has been selected. If the simultaneous multi-color copying mode has been selected, copying function based on the simultaneous multi-color copying control is effected (step #32), while if it has not been selected, the normal copying function is to be effected (step #33).

It is to be noted here that, in the foregoing embodiment, since the first developing unit 4 is set to be of red, with the second developing unit 5 set to be of black, the LED 74*a* and LED 74*b* are arranged to be illuminated or de-energized for the toner color display portion 74, but if the colors for the respective developing units are of other colors, display corresponding thereto should be effected.

By the foregoing embodiment, when the simultaneous multi-color copying mode has been selected, even if the developing unit select key 95 is depressed, the input thereby is to be neglected, and thus, the developing unit is not changed over. Accordingly, even in the case where the developing unit select key 95 is carelessly depressed during the simultaneous multi-color copying mode, the color for the developing unit after release of the simultaneous multi-color copying mode is the same as that before selection of the simultaneous multi-color copying mode, and thus, possibility of mis-copying through erroneous selection of color by an operator may be reduced.

In the foregoing embodiment, although the timing for terminating the development at the region boundary portion is adapted to be delayed by the predetermined time t3, t3*a* from the timing for the region boundary portion to pass through the developing position, this may be, for example, so modified, on the contrary, that the timing for starting the developing is advanced by the time t3, t3*a* from the timing for the region boundary portion to pass through the developing position.

Moreover, in the foregoing embodiment, although it is arranged to change over the developing colors in the order of black, color and further, to black, the color arranging pattern is not limited to the above, but the image editing pattern may be altered in various ways by changing the order of the developing unit for starting the development. Meanwhile, it may be so modified to provide one lever for change-over of the developing color only one time during one scanning operation, or on the contrary, to provide more than three levers.

Furthermore, in the foregoing embodiment, the two developing units 4 and 5 are provided around the photoreceptor drum to obtain the color print in two colors, but the arrangement is not limited to the above, and for example, it is possible to provide three or four developing units around the photoreceptor drum, thereby to obtain a color print in three or four colors.

Furthermore, in the foregoing embodiment, although the arrangement is so made that, during the non-developing period, the developing motor is stopped, with the magnet roller 13 rotated so as to retreat the magnetic pole from the developing region Xl for displacement thereof to the portion confronting the bristle height restricting member 19, the magnetic pole need not necessarily be displaced as in the above embodiment between the developing period and the non-developing period. However, if it is arranged as in the embodiment, the possibility in which the magnetic brush contacts the photoreceptor drum 1 is reduced to prevent the mixing in colors.

Similarly, the arrangement for subjecting the exposure lamp 41 to scanning function, with the original document platform 9 fixed in the foregoing embodiment, may be modified so that the original document platform 9 is caused to scan, with the exposure lamp 41 held stationary.

As is clear from the foregoing description, according to the present invention, in the case where the simultaneous multi-color copying mode has been selected, even if the developing unit selecting means is operated, input thereby is inhibited, and therefore, there is no possibility that the developing unit is undesirably changed over. Therefore, even in the case where the developing unit select means is carelessly depressed during the simultaneous multi-color copying mode, the color for the developing unit after release of the simultaneous multi-color copying mode is the same as that before selection of the simultaneous multi-color copying mode, and thus, mis-copying by the operator due to undesirable change of color for the developing unit can be advantageously prevented.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A copying apparatus comprising:

an electrostatic latent image holding member rotatively supported in the housing of the copying apparatus;

means for exposing an image so as to form an electrostatic latent image on said electrostatic latent image holding member;

a developing means which is disposed in the periphery of said electrostatic latent image holding member in the housing of the copying apparatus, and has at least a first developing unit housing a first developer and a second developing unit housing a second developer different in the color thereof from the color of the first developer housed in the first developing unit;

a switching means for switching a copy mode from a first mode in which a monochrome copying operation is carried out by selecting any one of the developing units to a second mode in which a plural color copying operation is carried out during one image exposure operation and vice versa;

a developing unit selection means for selecting and specifying any one of the developing units; and an inhibiting means for inhibiting the selection of the developing unit when the second mode is specified by said switching means.

2. A copying apparatus as claimed in claim 1, further comprising:

an original document placing plates which is disposed at a predetermined place of a housing of the copying apparatus and on which an original document is placed so as to be exposed by exposing means; and a control means which controls the developing means for developing an electrostatic latent image corresponding to a region specified by said region specifying means by the first developing unit housing the first developer during one image exposure operation and for developing an electrostatic latent image corresponding to a region specified by said region specifying means by the second developing unit housing the second developer.

3. A copying apparatus comprising:

an original document placing plate which is disposed at a predetermined place of a housing of the copying apparatus and on which an original document is placed;

an electrostatic latent image holding member rotatably supported in the housing of the copying apparatus;

means for forming an electrostatic latent image, disposed in the vicinity of said original document placing plate, for exposing an image of the original document placed on said original document placing plate so as to form an electrostatic latent image, corresponding to the image of the original document, on said electrostatic latent image holding member;

a developing means which is disposed in the periphery of said electrostatic latent image holding member in the housing of the copying apparatus, and has at least a first developing unit housing a first developer and a second developing unit housing a second developer different in the color thereof from the color of the first developer housed in the first developing unit;

a supply means, disposed at a predetermined place of the housing of the copying apparatus, for supplying a material to be copied sequentially to said electrostatic latent image holding member;

a transfer means, disposed in the periphery of said electrostatic latent image holding member in the housing of the copying apparatus, for transferring the developed image to the material to be copied supplied by said supply means;

a switching means for switching a copy mode from a first mode in which a monochrome copying operation is carried out by selecting any one of the developing units to a second mode in which a plural color copying operation is carried out during one image exposure operation and vice versa;

a developing unit selection means for selecting and specifying any one of the developing units;

a first mode copying operation means for carrying out a monochrome copying operation when the first mode is specified by said switching means;

a second mode copying means for carrying out a copying operation in the second mode when the second mode is specified by said switching means; and an inhibiting means for inhibiting the selection of the developing unit in the second mode.

4. A copying apparatus as claimed in claim 3, further comprising a region specifying means for specifying a region of the original document image to be developed by the first developer so as to be copied and a region of the original document image to be developed by the second developer so as to be copied, said second mode copying means developing an electrostatic latent image corresponding to a region specified by said region specifying means by the first developing unit housing the first developer during one image exposure operation and developing an electrostatic latent image corresponding to a region specified by said region specifying means by the second developing unit housing the second developer.

* * * * *